United States Patent [19]

Lawson

[11] Patent Number: 4,826,243

[45] Date of Patent: May 2, 1989

[54] RECLINER CHAIRS

[75] Inventor: Gregory M. Lawson, Tupelo, Miss.

[73] Assignee: Super Sagless Corporation, Tupelo, Miss.

[21] Appl. No.: 67,140

[22] Filed: Jun. 25, 1987

[51] Int. Cl.[4] ..... A47C 1/02

[52] U.S. Cl. ..... 297/85; 297/89

[58] Field of Search ..... 297/89, 85, 84, 83

[56] References Cited

U.S. PATENT DOCUMENTS

| | | | |
|---|---|---|---|
| 2,870,821 | 1/1959 | Luckhardt | 297/89 |
| 2,937,693 | 5/1960 | Dubeck | 297/89 |
| 3,243,227 | 3/1966 | Katz | 297/85 |
| 3,537,747 | 11/1970 | Rogers | 297/85 |
| 4,113,305 | 9/1978 | Hampton | 297/85 |
| 4,186,062 | 2/1980 | Rogers, Jr. et al. | 297/85 |
| 4,690,454 | 9/1987 | Mizelle | 297/89 |
| 4,707,025 | 11/1987 | Rogers | 297/85 |

*Primary Examiner*—Francis K. Zugel

*Attorney, Agent, or Firm*—Wolf, Greenfield & Sacks

[57] ABSTRACT

A three-position reclining chair with a stationary frame, and a movable seat and backrest fixed with respect to one another. A handle actuated mechanism supports the seat and backrest within the frame and includes a mounting plate attached to the frame arms, a carrier link pivoted at its rear end on the mounting plate, and a seat mounting link carrying the seat and backrest and pivoted at its rear end on a rear pivot link and at its front end on a front pivot link, in turn respectively supported on the mounting plate and carrier link. A lazy tong linkage mounts on a footrest on the seat mounting link and front pivot link. The handle assembly with the assist of a spring pivots the rear pivot link to move the chair from an upright to an intermediate reclining position, and pressure against the backrest pivots the carrier link on the mounting plate to move the chair from the intermediate to the fully reclined position.

11 Claims, 8 Drawing Sheets

RECLINER CHAIRS

INTRODUCTION

This invention relates to reclining chairs and more particularly is embodied in a handle operated three-position recliner.

Recliner chairs have enjoyed great popularity for many years. Literally, millions of reclining chairs have been sold.

Most of the more recently developed reclining chairs are handled actuated. The handles are very easy to operate and have become recognized as a mark of better quality products. At the same time, the industry has become more and more competitive, and substantial time and energy have been expended in decreasing the manufacturing costs.

The principle object of the present invention is to provide a reclining chair mechanism which may be manufactured very inexpensively, and which nevertheless is handle actuated.

Another important object of the present invention is to provide a reclining chair mechanism which may be installed very easily on the fixed frame of a reclining chair.

To accomplish these and other objects, the reclining chair mechanism of the present invention includes a mounting plate which is fixed to the chair arms which in turn are rigid to the frame and rest on the floor. The mounting plate pivotally supports a carrier link having a fixed pivot on the mounting plate adjacent its rear end. A rear pivot link is connected intermediate its ends on the mounting plate and in turn carries the rear end of a seat mounting link. A front pivot link is connected on the front end of the carrier link, and it in turn supports the front end of the seat mounting link. A footrest is provided on a lazy tong linkage which in part is mounted on the front of the seat mounting link and in part on the front pivot link. A handle actuating assembly is mounted on the mounting plate and is connected through a pair of links to the rear pivot link. When the handle is actuated, the rear pivot link draws the seat mounting link rearwardly causing the front pivot link to pivot and raise the front end of the seat mounting and elevate the footrest. This action moves the chair from the upright to the intermediate reclining position. To move the chair to the fully reclined position, the occupant pushes against the arm rests, which tilts the backrest rearwardly. This action elevates the front end of the carrier link so as to afford very substantial backward tilting of the seat and backrest.

These and other objects and features of the present invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 1:
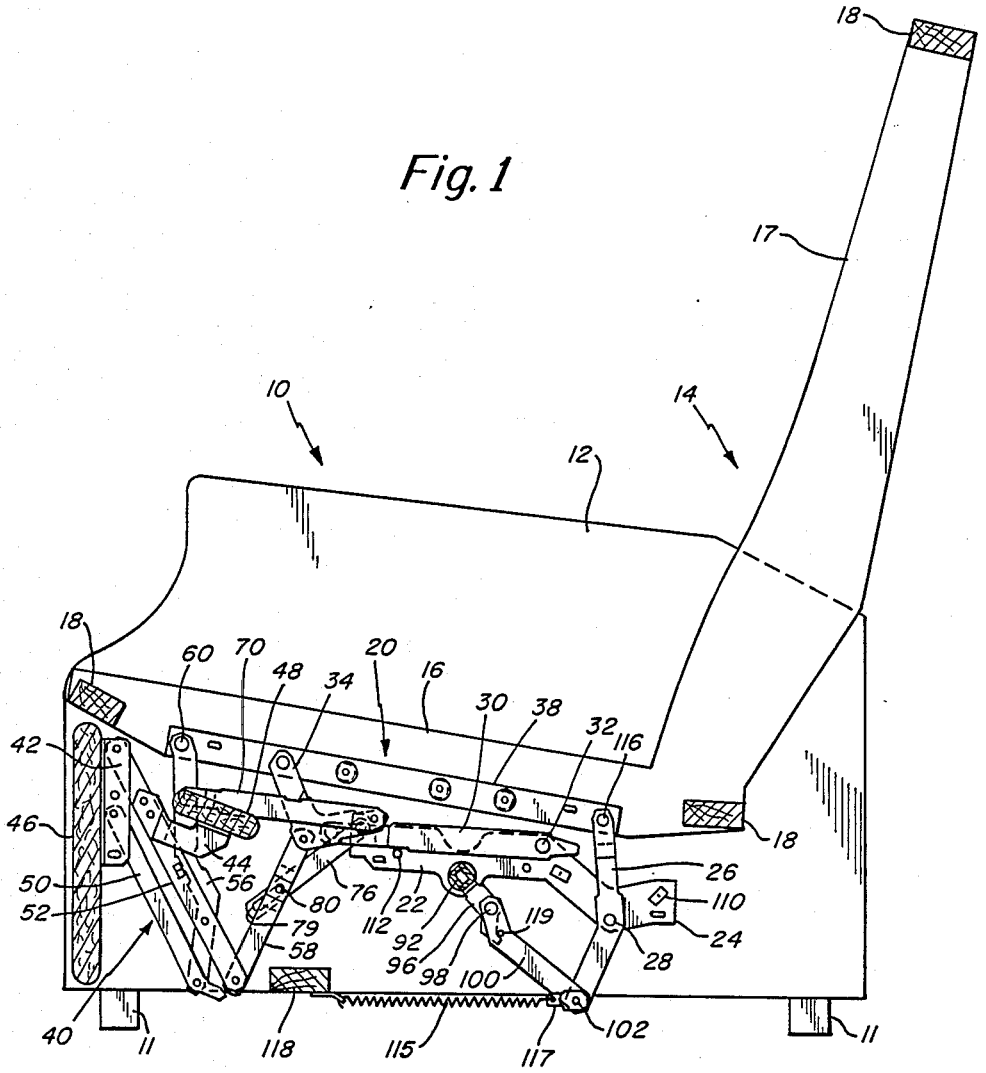
FIG. 1 is a side elevation view of a reclining chair constructed in accordance with this invention.
Figure 2:
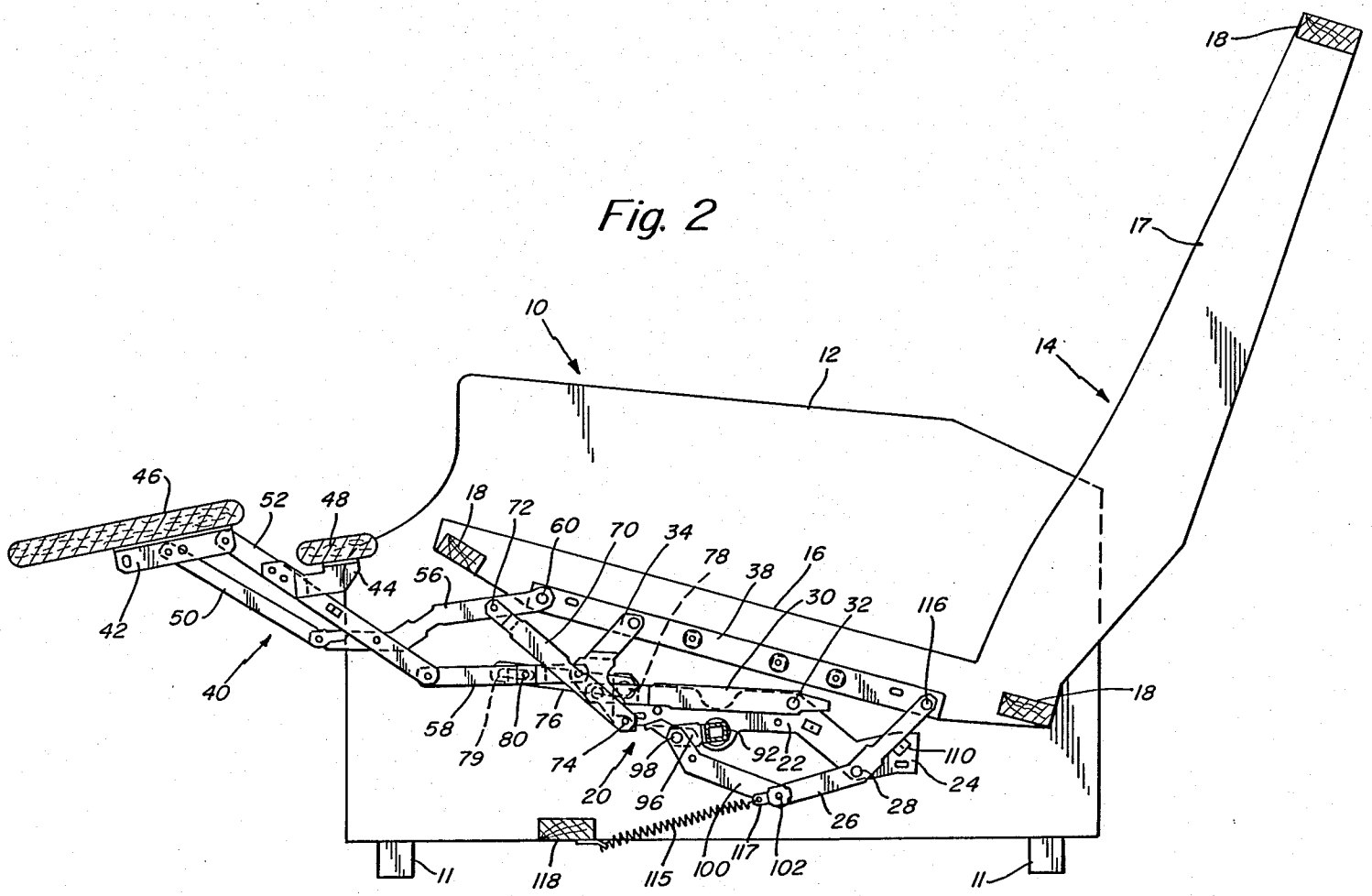
FIG. 2 is side elevation view of the chair shown in FIG. 1, but in the TV or intermediate reclining position.
Figure 2A:
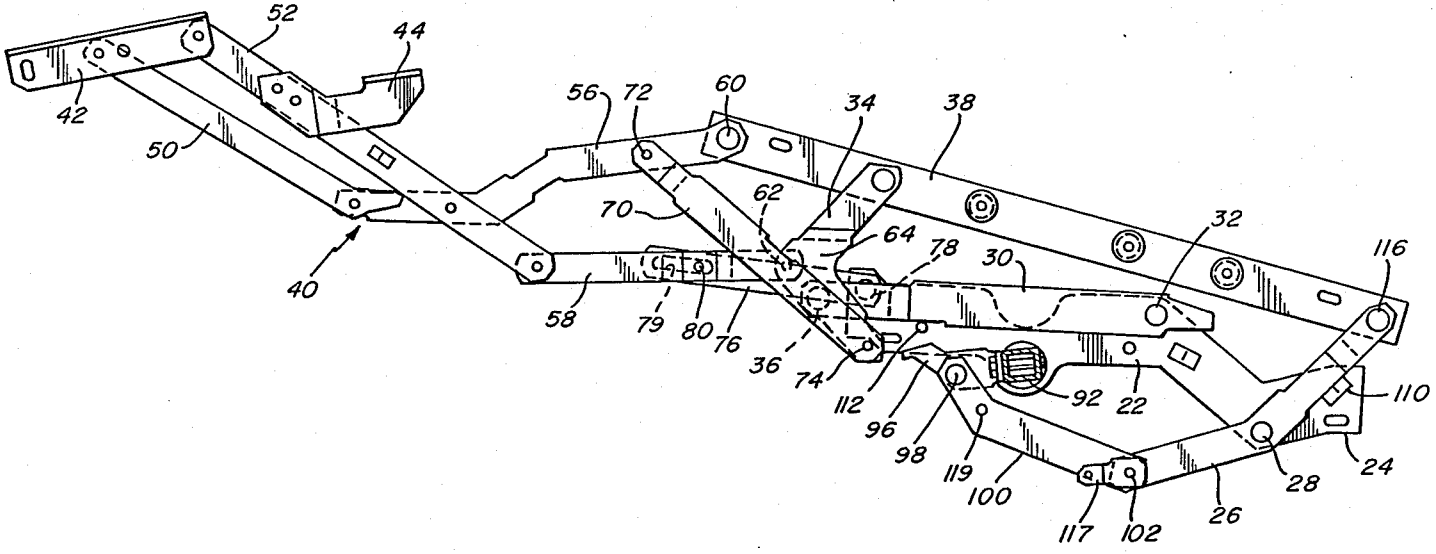
FIG. 2A is an enlarged detail view of the mechanism of FIG. 2.
Figure 3:
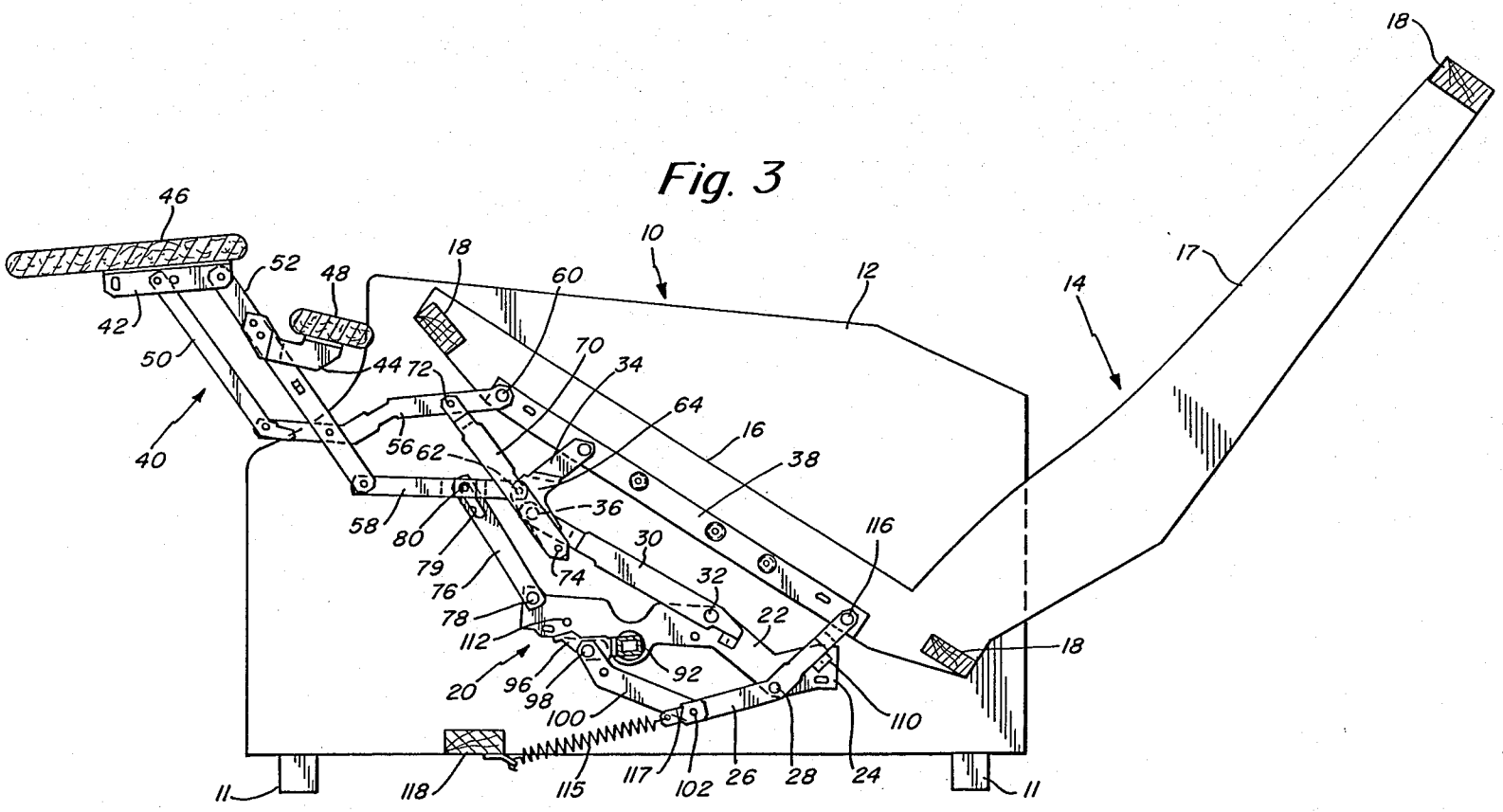
FIG. 3 is a side elevation view of the chair of FIGS. 1 and 2 shown in the fully reclined position.
Figure 3A:
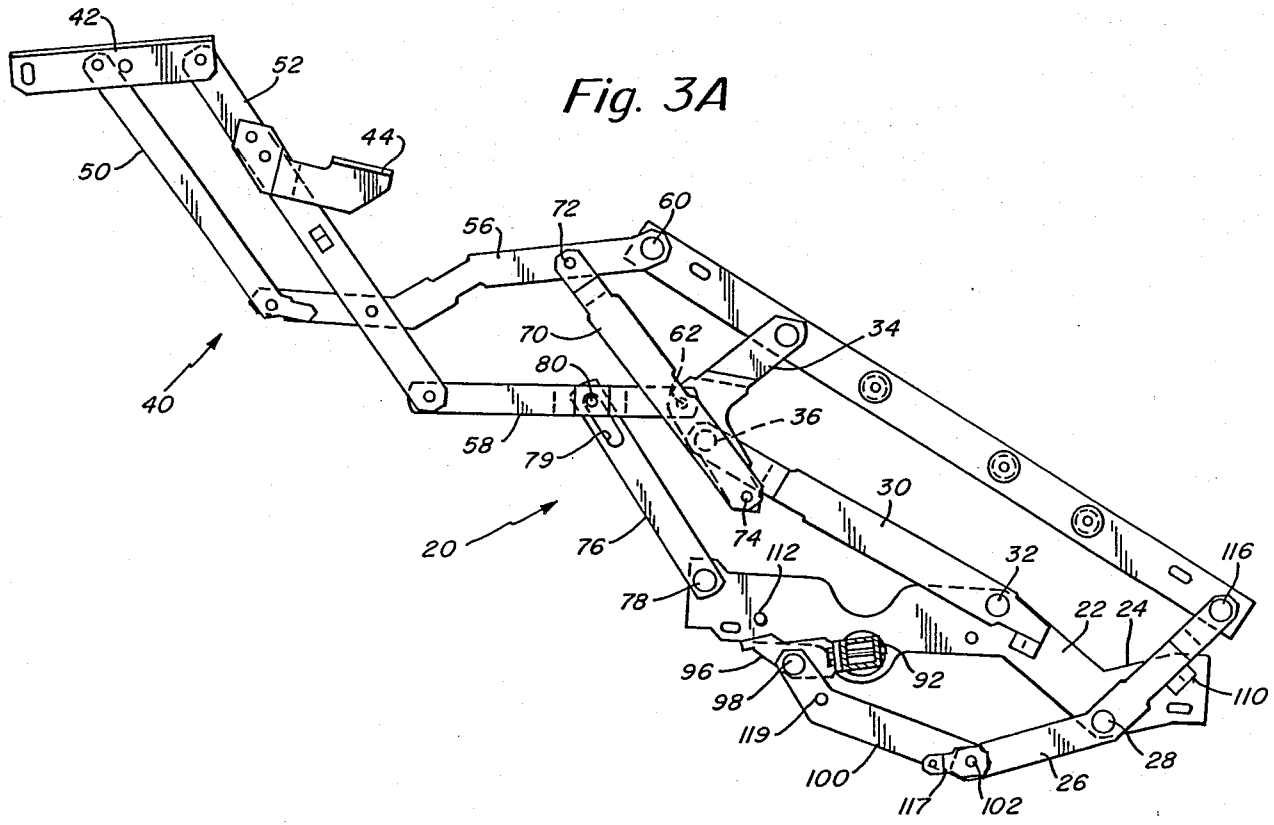
FIG. 3A is an enlarged detail view of the mechanism in the position of FIG. 3.

The chair shown in FIGS. 1–3 includes a stationary frame 10 having legs 11 which support the frame on the floor. The frame also includes arms 12 on each side which remain fixed as the chair moves between each of its three positions. Disposed within the frame is seat and back assembly 14 comprising a seat 16 and backrest 17 that are secured together and are fixed with respect to one another. Reclining chairs with a fixed back and seat are known as two-way chairs. The seat and back assembly 14 includes a wooden frame of which cross-braces 18 are shown. The seat and back assembly 14 is supported within the frame 10 by linkage mechanisms 20, one of which is disposed on each side of the frame and beneath the seat 16. Because the mechanisms 20 on each side of the chair are mirror images of one another, only one is described.

Each mechanism 20 disposed on the sides of the chair has a mounting plate 22 that bolts to an arm 12. Mounting plate 22 at its rear end 24 carries a rear pivot link 26 on rivet 28 connected to the rear pivot link intermediate its ends.

Mounting plate 22 also supports a carrier link 30 connected to it by rivet 32. The carrier link extends forwardly from pivot rivet 32 generally parallel to the major portion of the mounting plate. The front end of the carrier link 30 pivotally supports the front pivot link 34 at rivet joint 36. The rear pivot link 26 and the front pivot link 34 at their upper ends pivotally support seat mounting link 38 for fore and aft swinging motion within the arms 12 of the chair. The seat mounting link 38 in turn carries the seat and back assembly 14 of the chair.

A lazy tong linkage 40 carries a main footrest bracket 42 and secondary footrest bracket 44, which in turn support the principal and secondary footrests 46 and 48, respectively. The lazy tong linkage 40 includes links 50 and 52 each connected at one end to the main footrest bracket 42. The other ends of the links 50 and 52 are pivotally connected to footrest drive link 56 and footrest lifting lever 58, respectively. The drive link 56 is connected at its upper end by rivet 60 to the forward end of seat mounting link 38, while the footrest lift lever 58 is connected at its upper end by rivet 62 to the elbow 64 of front pivot link 34. As is evident in the drawings, the lazy tong linkage 40 moves between a retracted position wherein the principal footrest 46 is disposed vertically beneath the front edge of seat 16, while the secondary footrest 48 is disposed beneath the seat 16, and an extended position wherein the principal footrest 46 is elevated to a substantially horizontal position spaced from the front edge of the seat and the secondary footrest 48 is disposed between them. The secondary footrest essentially fills the gap between the front of the seat cushion and the principal footrest and prevents the chair occupant or anyone else from having a part of his person or clothing being trapped between the seat and principal footrest when the chair moves from the reclining to the upright position.

Figure 1A:
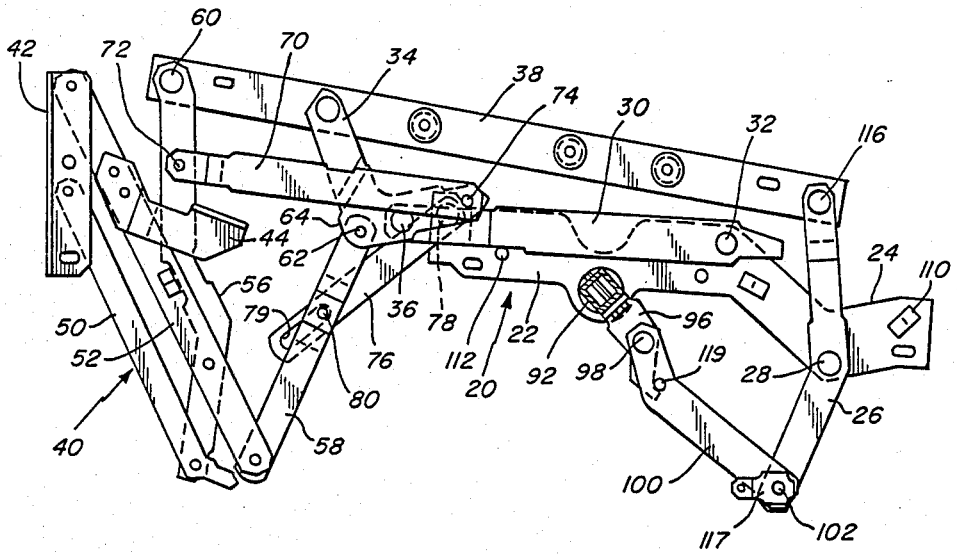
FIG. 1A is an enlarged detail view of the mechanism forming part of the chair and in the position in FIG. 1.

A control link 70 is pivotally connected at its front end by rivet 72 to the footrest drive link 56 near the upper end of the footrest drive link. The control link 70 is also pivotally connected by rivet 74 to the end of front pivot link 34. The mechanism associated with the lazy tong linkage 40 is completed by the sequencing link 76 which is pivotally connected by rivet 78 to the front end of the mounting plate 22. The lower end of the sequencing link 76 (as viewed in FIGS. 1 and 1A) has an elongated slot 79 which receives a rivet 80 carried by the footrest lift lever 58. The manner in which these parts operate is described in detail below in connection with the operation of the chair.

Figure 4:
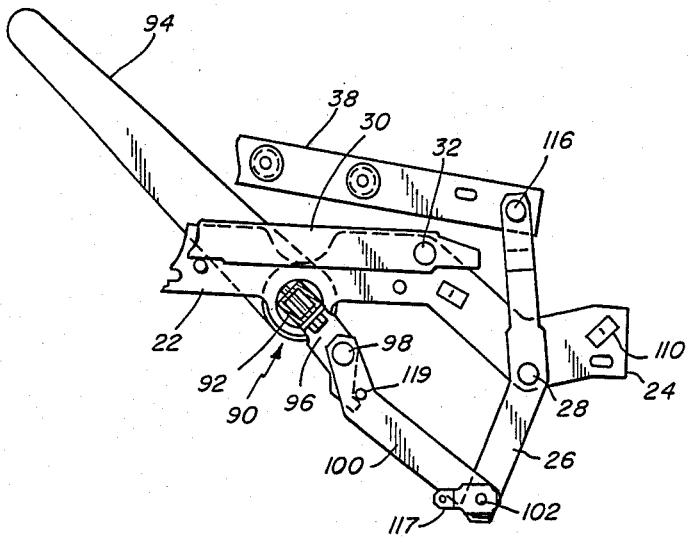
FIG. 4 is a fragmentary view of the mechanism and showing the handle actuating assembly.
Figure 5:
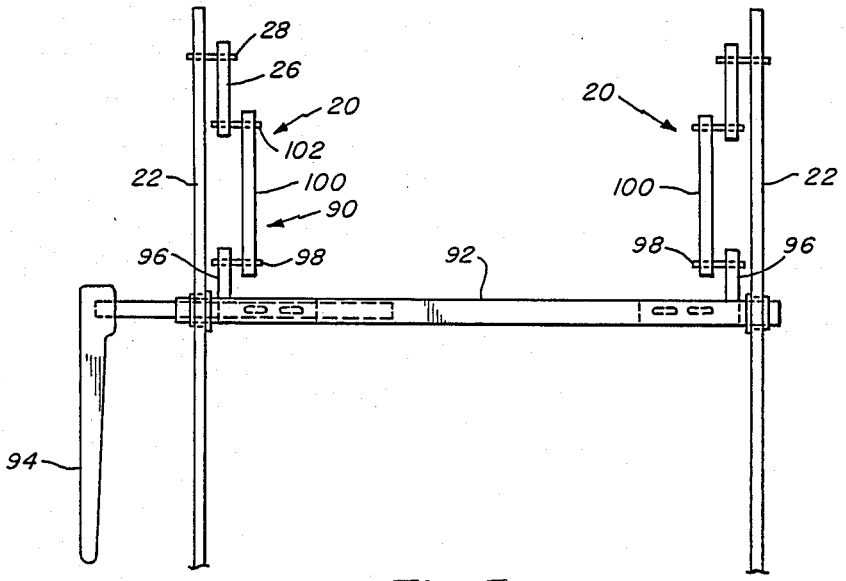
FIG. 5 is a top plan view, partially diagrammatic, of the handle actuating assembly.

As shown in FIG. 4, a handle assembly 90 is mounted on the mounting plate 22 on shaft 92 which extends through the arm on one side of the chair and which extends transversely across the chair to the linkage on the other side. The handle assembly 90 includes the actuating handle 94 which is connected to a stop link 96 which pivots with it about the axis of shaft 92. Stop link 96 is pivotally connected by rivet 98 to lock link 100. The lower end of lock link 100 in turn is connected to the lower end of rear pivot link 26 by rivet 102.

As shown in FIG. 1 only, a coil spring 115 is connected under tension between a bracket 117 supported on rivet 102 and the lower cross brace 18. Spring 115 urges the lower end of the rear pivot link 26 to swing forwardly about the pivot 28. When the handle 94 is in the forward position, this action is resisted by the stop 119 on lock link 100, which engages the stop link 96 (see FIG. 4). When the handle is pulled rearwardly, the end of the stop link is removed from the path of stop 119 and the spring 115 is free to pull the rear pivot link 26 so as to move the chair to the TV position as is more fully described below.

The chair operates in the following manner:

In FIG. 1, the chair is shown in its upright position with the seat and backrest rigidly connected to one another and carried between the arms of the chair on the seat mounting link 38. (See also linkage in FIG. 1A.) The lazy tong linkage 40 is retracted so that the main footrest 46 is disposed beneath the front edge of the seat cushion and the secondary footrest 48 is hidden beneath the seat. When the occupant wants to shift the chair from the upright position of FIG. 1 to the TV position of FIG. 2, he or she pulls the handle 94 rearwardly causing it to pivot clockwise about shaft 92 as shown in the drawings. This action causes the stop link 96 to swing toward the position shown in FIG. 2 and draw the lock link 100 forwardly with it. This in turn causes the rear pivot link 26 to pivot in a clockwise direction about rivet 28 on the mounting plate 22 causing the seat to translate rearwardly with respect to the chair arms. Spring 115 shown in FIG. 1 assists in pulling the bottom of the rear pivot link 26 in a forward direction so that it pivots in a clockwise direction about rivet 28. As the rear pivot link pulls the seat mounting link 38 rearwardly, the front pivot link 34 pivots about rivet 36 on the end of carrier link 30, which raises the forward end of the seat mounting link. The clockwise pivotal motion of the front pivot link 34 on rivet 36 also acts upon the footrest control link 70 which moves in a generally forwardly direction and exerts a force through rivet 72 on the footrest drive link 56 so as to extend the lazy tong linkage 40 and elevate the principal footrest 46 and secondary footrest 48 to the positions in FIG. 2. During this action, the lift lever 58 also pushes the footrest link 52 upwardly and forwardly to assist in opening the footrest, and the rivet 80 carried by lift lever 58 moves along the slot 78 in the sequence link 76. The rearward travel of the rear pivot link 26 is limited by stop 110 on the mounting plate 22.

This sequence causes the seat 16 to move rearwardly as its front end is elevated and the rear end is lowered. The backrest which is rigidly connected to the seat correspondingly moves downwardly and tilts rearwardly with the seat mounting link 38. This is evident in a comparison of FIGS. 1 and 2. During the movement of the chair from the upright to the TV position, carrier link 30 remains fixed on the mounting plate 22 carried at its rear end by rivet 32 and supported on stop 112 at its forward end also carried on the mounting plate.

To move the chair from the TV position shown in FIG. 2 to the fully retracted position shown in FIG. 3, the chair occupant pushes on the arms 12. This action causes the carrier link 30 to pivot in a clockwise direction about rivet 32 so that its front end lifts off stop 112 and raises the front pivot link 34. The elevation of the front end of the carrier link 30 and front pivot link 34 in that fashion raises the front end of the seat mounting link 38 and rotates the seat and backrest assembly about the rivet 116 which connects the upper end of the rear pivot link 26 to seat mounting link 38. While the angle between the seat and backrest remains unchanged, the two together pivot clockwise as viewed in the drawings so as to elevate the front of the seat and swing the top of the backrest 17 rearwardly and downwardly. During this latter action as the chair moves from the TV to the fully reclined position, the front pivot link 34 remains stationary with respect to the carrier link 30. To return the chair from the fully reclined to the TV position, the occupant relieves pressure against the backrest, which allows the carrier link 30 to return to the position shown in FIG. 2 wherein its forward end rests on stop 112. The sequencing link 76 prevents the footrest from closing during this motion. After the chair returns to the position shown in FIG. 2, the occupant merely presses his or her legs firmly against the main footrest 46, which causes the lazy tong linkage 40 to collapse and to return to the position of FIG. 1.

Having described the invention in detail, it will be appreciated that this invention includes a linkage mechanism which provides an inexpensive chair with the attributes of those chairs using much more expensive mechanisms.

Because numerous modifications may be made of this invention without departing from its spirit, the scope of this invention is not to be limited to the specific embodiment illustrated and described. Rather, the scope of this invention is to be determined by the appended claims and their equivalents.

What is claimed is:

1. A two-way, three-position reclining chair comprising a frame including a pair of fixed arms, a seat and backrest assembly with the seat and backrest fixed with respect to one another, a footrest, and linkage mechanisms for supporting the seat and backrest assembly and the footrest on the frame, each of said mechanisms including a mounting plate attached to an arm of the chair, a carrier link pivotally connected adjacent its rear end to the mounting plate, a rear pivot link pivotally mounted intermediate its ends on the mounting plate and having upper and lower ends, a front pivot link pivotally mounted on the forward end of the carrier link and having upper and lower ends, a seat mounting link connected at its front and back to the upper ends of the rear and front pivot links and carrying the seat and backrest assembly, a lazy tong linkage connected in part to the seat mounting link and in part to the front pivot link, a handle actuating assembly mounted on the mounting plate and connected to the lower end of the rear pivot link for pivoting the rear pivot link on the mounting plate so that its upper end moves rearwardly and downwardly causing the back of the seat mounting link to move rearwardly and downwardly when the handle is actuated and to pivot the front pivot link so as to extend the lazy tong linkage and raise the footrest whereby the chair moves from an upright to TV position, and said carrier link being free to move upwardly at its front end enabling the occupant to exert a backward force against the backrest causing the seat mounting link to pivot upwardly at the front about the rear pivot link as the front end of the carrier link rises so as to move the seat and backrest together from the TV position to the fully reclined position.

2. A chair as in claim 1 wherein a footrest control link is connected to one end of the front pivot link and to the lazy tong linkage for extending the linkage in a forward direction as the front pivot link moves the seat mounting link in a rearward direction.

3. A chair as in claim 1 wherein a stop is carried by the mounting plate and in the path of travel of the rear pivot link for preventing the rear pivot link from moving as the seat mounting link moves from the TV position to the fully reclined position.

4. A chair as in claim 2 wherein a stop is carried by the mounting plate and in the path of travel of the rear pivot link for preventing the rear pivot link from moving as the seat mounting link moves from the TV position to the fully reclined position.

5. A three-position reclining chair having fixed arms, a movable seat and a mechanism for supporting the seat between the arms, said mechanism comprising a mounting plate attached to an arm of the chair, a carrier link pivotally connected adjacent its rear end to the mounting plate, a rear pivot link pivotally mounted intermediate its ends on the mounting plate and having upper and lower ends, a front pivot link pivotally mounted on the forward end of the carrier link and having upper and lower ends, a seat mounting link connected at its front and back ends to the upper ends of the front and rear pivot links and carrying the seat, a handle actuating assembly mounted on the mounting plate and connected to the lower end of the rear pivot link causing the rear pivot link to move the back of the seat mounting link rearwardly and downwardly and to elevate the front end of the seat mounting link on the front pivot link when the handle is actuated to recline the seat, and said carrier link being free to move upwardly at its front end about its pivotal connection to the mounting plate enabling the occupant to cause the seat mounting link to pivot upwardly at the front on the rear pivot link and raise the carrier link to further recline the seat to the fully reclined position.

6. A chair as in claim 5 wherein the chair includes a backrest which is rigidly connected to and immovable with respect to the seat.

7. A chair as in claim 6 wherein a stop is carried by the mounting plate and in the path of travel of the rear pivot link for preventing the rear pivot link from moving as the seat mounting link moves from the TV position to the fully reclined position.

8. A chair as in claim 5 wherein a footrest carried by a footrest linkage is connected to the seat mounting link and the front pivot link whereby the footrest is extended as the front end of the seat mounting link is elevated as the seat moves to the TV position.

9. A chair as in claim 8 wherein the chair includes a backrest which is rigidly connected to and immovable with respect to the seat.

10. A reclining chair mechanism comprising a mounting plate, a carrier link pivotally connected adjacent its rear end to the mounting plate, a rear pivot link pivotally mounted intermediate its ends on the mounting plate and having upper and lower ends, a front pivot link pivotally mounted on the forward end of the carrier link and having upper and lower ends, a seat mounting link connected at its front and back ends to the upper ends of the rear and front pivot links, a footrest linkage connected to the seat mounting link and front pivot link, and a handle actuating assembly mounted on the mounting plate and connected to the lower end of the rear pivot link for pivoting the rear pivot link so as to move the upper end of the rear pivot link rearwardly and downwardly to lower the back of the seat mounting link and thereby causing the front pivot link to pivot and elevate the front of the seat mounting link and extend the footrest linkage.

11. A chair as in claim 1 wherein a spring is connected between the handle actuating assembly and the frame to urge the upper end of the rear pivot link to move rearwardly with respect to the mounting plate.

* * * * *